US008720672B2

(12) United States Patent
Holland-Letz

(10) Patent No.: US 8,720,672 B2
(45) Date of Patent: May 13, 2014

(54) DEVICE FOR INPUTTING SECURITIES INTO A CONTAINER

(75) Inventor: Günter Holland-Letz, Paderborn (DE)

(73) Assignee: Wincor Nixdorf International GmbH (DE)

( * ) Notice: Subject to any disclaimer, the term of this patent is extended or adjusted under 35 U.S.C. 154(b) by 210 days.

(21) Appl. No.: 13/260,044

(22) PCT Filed: Mar. 19, 2010

(86) PCT No.: PCT/EP2010/053612

§ 371 (c)(1),
(2), (4) Date: Dec. 7, 2011

(87) PCT Pub. No.: WO2010/108864

PCT Pub. Date: Sep. 30, 2010

(65) Prior Publication Data

US 2012/0085625 A1 Apr. 12, 2012

(30) Foreign Application Priority Data

Mar. 27, 2009 (DE) ..... 10 2009 015 383

(51) Int. Cl.

| | |
|---|---|
| ***B65H 29/40*** | (2006.01) |
| ***B65H 31/26*** | (2006.01) |
| ***B65H 29/22*** | (2006.01) |

(52) U.S. Cl.

CPC ..... *B65H 29/40* (2013.01); *B65H 31/26* (2013.01); *B65H 29/22* (2013.01); *Y10S 902/17* (2013.01)

USPC ..... 198/722; 271/120; 902/17

(58) Field of Classification Search

USPC ..... 198/722, 723, 732; 271/3.12, 271/10.9–10.13, 119, 120, 81, 221, 315; 902/13–17

See application file for complete search history.

(56) References Cited

U.S. PATENT DOCUMENTS

| | | | | |
|---|---|---|---|---|
| 3,649,003 | A * | 3/1972 | Muller et al. | 271/120 |
| 4,043,549 | A * | 8/1977 | Rinehart | 271/118 |

(Continued)

FOREIGN PATENT DOCUMENTS

| | | | |
|---|---|---|---|
| EP | 1411012 | A2 | 4/2004 |
| EP | 0994445 | B1 | 3/2008 |
| JP | 2003171068 | A | 6/2003 |

OTHER PUBLICATIONS

International Preliminary Report on Patentability (Chapter I of the Patent Cooperation Treaty) for PCT/EP2010/053612 (in German), issued Sep. 27, 2011.

(Continued)

*Primary Examiner* — Mark A Deuble

(74) *Attorney, Agent, or Firm* — Harness, Dickey & Pierce, P.L.C.

(57) ABSTRACT

The invention relates to a device for the input of notes of value into a container. The device comprises a supply unit for supplying the notes of value and a stacking unit for stacking the supplied notes of value. Further, the device has a vane wheel (10*c*) for handling the notes of value. The vane wheel (10*c*) comprises a rotatably mounted basic body (12*c*) and at least one vane (14*c*, 16*c*) firmly connected to the basic body (12*c*) at a first end of a connecting area (20*c*, 22*c*). A support area (38, 40) of the vane (14*c*, 16*c*) contacts the circumferential surface of the basic body (12*c*) when the vane (14*c*, 16*c*) exerts a force on a note of value.

18 Claims, 4 Drawing Sheets

(56) References Cited

U.S. PATENT DOCUMENTS

| | | | | |
|---|---|---|---|---|
| 4,205,837 | A * | 6/1980 | von Hein et al. | 271/270 |
| 4,475,733 | A * | 10/1984 | Benson | 271/120 |
| 4,585,226 | A * | 4/1986 | LaBate | 271/264 |
| 5,000,437 | A * | 3/1991 | Schneider et al. | 271/187 |
| 5,098,080 | A * | 3/1992 | Arnone et al. | 271/187 |
| 5,415,390 | A | 5/1995 | Guerrero | |
| 6,968,997 | B2 * | 11/2005 | Nomiyama et al. | 235/381 |
| 7,458,572 | B2 * | 12/2008 | Sato et al. | 271/119 |
| 8,276,902 | B2 * | 10/2012 | Holland-Letz et al. | 271/3.14 |
| 2005/0200073 | A1 | 9/2005 | Mizuno | |
| 2008/0136090 | A1 | 6/2008 | Bober | |

OTHER PUBLICATIONS

English Translation of International Preliminary Report on Patentability (Chapter I of the Patent Cooperation Treaty) for PCT/EP2010/053612, issued Nov. 1, 2011.

International Search Report (in English) and Written Opinion of the International Searching Authority (in German) for PCT/EP2010/053612, mailed Aug. 20, 2010; ISA/EP.

* cited by examiner

DEVICE FOR INPUTTING SECURITIES INTO A CONTAINER

CROSS-REFERENCE TO RELATED APPLICATIONS

This application is a U.S. National Stage of International Application No. PCT/EP2010/053612, filed Mar. 19, 2010 and published in German as WO 2010/108864 A1 on Sep. 30, 2010. This application claims the benefit and priority of German Application No. 102009015383.7, filed Mar. 27, 2009. The entire disclosures of the above applications are incorporated herein by reference.

BACKGROUND

This section provides background information related to the present disclosure which is not necessarily prior art.

1. Technical Field

The invention relates to a device for the input of notes of value into a container. The device comprises a supply unit for supplying the notes of value and a stacking unit for stacking the supplied notes of value. Further, the device comprises at least one vane wheel for handling the notes of value. The vane wheel in turn comprises a rotatably mounted basic body and at least one vane which is firmly connected to the basic body at a first end of a connecting area. The vane has a press-on area for exerting a force on at least one note of value.

2. Discussion

The invention can in particular be used in connection with automated teller machines, automatic cash safes and/or automatic cash systems into which notes of value, preferably banknotes are deposited. The deposited notes of value are stored in the form of a stack in a storing area of the container. The notes of value are individually supplied to the storing area and stacked in the storing area such that a note of value to be supplied is supplied to an already existing stack at the front side thereof. The front or the rear side of the note of value to be supplied and the front or the rear side of the note of value supplied to the stack immediately before are arranged opposite to each other. The vane wheel presses the last supplied note of value against the stack. In order to ensure a compact design of the device, the device is constructed such that, when the vane wheel is rotated, the vanes of the vane wheel are strongly bent by the contact with adjacent elements.

From the document EP 0 994 445 B1, a banknote deposit and banknote withdrawal machine comprising an upper support unit for banknotes and a lower support unit for banknotes for supporting and transporting the banknotes in a banknote stacking direction or in the counter-stacking direction is known. The upper portion of an upright standing banknote is held by the upper support unit. The lower portion of the upright standing banknote is held by the lower support unit. The support units are in particular vane wheels with a basic body and vanes arranged radially to the basic body. As a result of the radial connection of the vanes to the basic body, the vanes are relatively strongly bent by the contact with adjacent elements, i.e. the curvature of the vane has a small radius of curvature. Especially in the connecting area where the vanes are connected to the basic body, the vanes are subjected to high stresses due to the strong bending and the high stiffness required for holding the notes of value. This may result in material fatigue, in particular in a decrease in the stiffness and a decrease in the tension. This in turn, however, no longer guarantees the proper functioning of the vane wheel.

SUMMARY OF THE INVENTION

It is an object of the invention to specify a device for the input of notes of value into a container and a vane wheel for handling notes of value, in which the vane of the vane wheel is subjected to a low uniform stress.

By the contact between the support area of the vane and the circumferential surface of the basic body when a force is exerted by the vane on a note of value, it is achieved that at least a part of the support area rests against the basic body and thus that the vane is supported by the basic body. This causes that the force exerted by the vane on the note of value is transmitted from the vane onto the basic body via a large area. Further, as the support area of the vane rests against the basic body it is achieved that the vane is elastically deformed with a low curvature only, i.e. a curvature having a large radius of curvature. This causes that the vane, compared to a radial arrangement of the vane relative to the basic body, is subjected to a substantially lower mechanical stress and a uniform stress distribution is achieved. In particular, the occurrence of stress peaks, in particular in the connecting area, is prevented or at least reduced. This is turn prevents or reduces material fatigue so that the decrease in the stiffness and the decrease in the tension of the vane in the course of its lifetime are reduced and thus a sufficiently high force exerted by the vane on the note of value is guaranteed.

A second aspect of the invention relates to a vane wheel for handling notes of value. The vane wheel comprises a rotatably mounted basic body and at least one vane firmly connected to the basic body at a first end of a connecting area. The vane has a press-on area for exerting a force on at least one note of value and a support area. The support area contacts the circumferential surface of the basic body when the vane exerts a force on a note of value. It is advantageous when the vane exerts a force on the note of value substantially only when at least a part of the support area of the vane contacts the basic body.

Further, it is advantageous when the vane does not contact the basic body at least in an area between the connecting area and the support area whenever the vane exerts a force on the note of value and the support area contacts the circumferential surface of the basic body. It is particularly advantageous when the support area of the vane runs substantially parallel to a tangent to the basic body at a first point whenever the vane does not exert any force on a note of value. The point of connection where the vane is connected to the basic body is arranged downstream of the first point by a preset angle of <45°, as viewed in the direction of rotation of the basic body. The point of connection is in particular arranged downstream of the first point by an angle in the range between 10° and 30°. Such an arrangement of the vane is also referred to as a downstream connection of the vane. By means of this downstream connection of the vane to the basic body it is achieved that the vane, compared to a tangential connection of the vane at the first point, is longer and thus, the cross-section being equal, is softer. Thus, when the vane is bent, only relatively low mechanical stresses occur so that material fatigue is prevented. As the vane rests against the basic body when the vane exerts a force on a note of value, it is, despite the softer vane, guaranteed that a sufficiently high force is exerted on the note of value.

In a preferred embodiment of the invention, there is an angle in the range between 70° and 100° between the longitudinal axis of the connecting area of the vane and a tangent to the basic body at the point of connection. In a particularly preferred embodiment of the invention, the connecting area is radially attached to the circumferential surface of the basic body. Further, it is advantageous when there is an angle between 70° and 110°, in particular an angle of about 90°, between the connecting area and the support area in an unstressed state of the vane. The unstressed state of the vane is the state in which the vane does not exert any force on a note of value and is not deformed by the contact with an adjacent element. A transition area between the support area and the connecting area is preferably curved, in particular fashioned in the form of a radius.

In this way, the downstream connection of the vane to the basic body can be implemented easily and the vane wheel can be manufactured easily and cost-efficiently.

Further, it is advantageous to form the basic body and the vane as one piece. The vane wheel is in particular made by an injection molding process. In this way, a cost-efficient manufacturing of the vane wheel is achieved.

The basic body is preferably a hub rotatably mounted about its longitudinal axis. In this way, the vane wheel can be mounted on a shaft in a rotationally fixed manner and can be rotated by a rotation of the shaft.

In a preferred embodiment of the invention the vane wheel comprises two vanes. The vanes are in particular offset to each other by 180°. This guarantees that a value note stack received in a storing area of a container is reliably pressed into the storing area with the aid of the vane wheel so that a free supply area for positioning a further note of value to be supplied and to be stacked is created. In an alternative embodiment of the invention, the vane wheel may also comprise more than two vanes, in particular three or four vanes.

In addition, it is advantageous when at least a part of the vane has a curvature opposite to the direction of rotation of the vane wheel when a force is exerted on the note of value. For this, the vane is designed sufficiently elastically. In this way, it is achieved that the vane can be bent without being broken when it contacts elements arranged in the radius of the vane. For this, the vane wheel is in particular made of an elastomer, preferably an uncured elastomer.

It is particularly advantageous when the center of curvature of the curvature of the vane lies within a space defined by the circumferential surface of the basic body. The center of curvature preferably lies on the axis of rotation of the basic body. Thus, it is achieved, on the one hand, that the support area of the vane rests optimally against the circumferential surface of the basic body, and, on the other hand, that the curvature of the vane has a large radius of curvature. As a result of this large radius of curvature in turn the vane is subjected to a lower stress.

In addition, it is advantageous when the vane has a counter-curvature at the end opposite to the basic body, so that the backward tilt of the vane opposite to the direction of rotation of the basic body caused by the contact between the support area and the circumferential surface of the basic body is compensated for or at least reduced. In this way, it is guaranteed that the vane can exert a sufficiently high force on the note of value via the press-on area. For this, the vane preferably has an S-shaped area.

BRIEF DESCRIPTION OF THE DRAWINGS

Further features and advantages of the invention result from the following description which in connection with the enclosed Figures explains the invention in more detail with reference to embodiments.

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
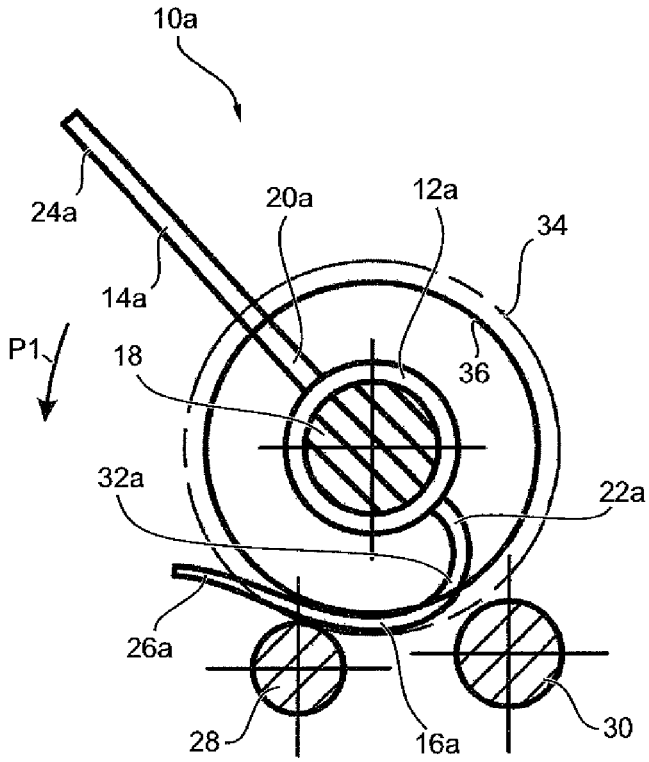
FIG. 1 PRIOR ART
FIG. 1 shows a schematic illustration of a known embodiment of a vane wheel.

In FIG. 1, a schematic illustration of a known embodiment of a vane wheel 10*a* is illustrated. The vane wheel 10*a* is in particular used in automated teller machines, automatic cash systems and/or automatic cash safes into which notes of value are deposited and stacked in value note storing areas. The notes of value are individually supplied to the value note storing area and are stored therein in a stacked manner standing on their longitudinal edge. The notes of value of the value note stack already received in the value note storing area are pressed with the aid of the vane wheel 10*a* against a press-on wall delimiting the value note storing area so that a free supply area is created in which the note of value to be stored in the value note storing area as the next note of value may be supplied to the value note storing area. In this way, it is prevented that a note of value to be supplied gets jammed with the notes of value of the value note stack during feeding and thus that a correct stacking of the notes of value cannot be guaranteed.

The vane wheel 10*a* comprises a hollow-cylindrical basic body 12*a* and two vanes 14*a*, 16*a* firmly connected to the basic body 12*a*. The basic body 12*a* is in particular designed as a hub. The vanes 14*a*, 16*a* are also referred to as paddles.

The basic body 12*a* is connected in a rotationally and spatially fixed manner to a shaft 18 (sectionally illustrated in FIG. 1) such that the longitudinal axis of the basic body 12*a* and the longitudinal axis of the shaft 18 coincide. When the shaft 18 rotates in the direction of rotation P1, then the vane wheel 10*a* likewise rotates in the direction of rotation P1.

The vanes 14*a*, 16*a* are connected at a first end of a connecting area 20*a*, 22*a* to the basic body 12*a* such that each time the longitudinal axis of the respective connecting area 20*a*, 22*a* is arranged radially to the basic body 12*a*. This radial arrangement of the vanes 14*a*, 16*a* is also referred to as radial connection. Further, each vane 14*a*, 16*a* comprises at least one press-on area 24*a*, 26*a* with which the vane 14*a*, 16*a* presses against the note of value that has been supplied as last note of value to the value note stack stacked in the value note storing area and thus exerts a force on this note of value and therefore likewise on the existing stack in order to create the supply opening for supplying a further note of value. So that a sufficient force is exerted on the last note of value of the value note stack, the vanes 14*a*, 16*a* must have a high stiffness. Further, the drive unit with which the shaft 18 and thus also the vane wheel 10*a* are driven must generate a sufficiently high torque. The drive unit not illustrated in FIG. 1 is in particular a stepper motor.

Further, two adjacent elements 28, 30 are shown in FIG. 1. These adjacent elements 28, 30 are in particular shafts or rods which are likewise sectionally shown in FIG. 1. The vanes 14*a*, 16*a* of the vane wheel 10*a* are strongly bent by the contact with the adjacent elements 28, 30 when the vane wheel 10*a* rotates in the direction of rotation P1. The vane 16*a* is illustrated in FIG. 1 in a position in which it is bent by the contact with the first adjacent element 28. In particular in an area of curvature 32*a*, a high curvature of the vane 16*a* is created. A high curvature is a curvature having a small radius of curvature or small radii of curvature.

Due to the high curvature of the vane 16*a*, high stresses, in particular high marginal stresses occur in the vane 16*a*, in particular in the connecting area 22*a*. As a result of the high stiffness of the vane 16*a*, the occurring stresses are particularly high. The occurring high stresses result in material fatigue in the course of the operation of the vane wheel 10*a*. In particular, the occurring high stresses cause a high decrease in the stiffness of the vanes 14*a*, 16*a* and thus a high decrease in the tension. This in turn may result in that the vanes 14*a*, 16*a* no longer exert the at least required force on the last note of value of the value note stack and thus in that it is no longer guaranteed that the notes of value of the value note stack are reliably held. Further, material fatigue may result in a failure of the vane wheel 10*a*. To apply the at least required force also when the stiffness diminishes, the drive unit for driving the shaft 18 has to drive the shaft 18 at a higher speed. The non-uniform curvature of the vane 16*a* causes a likewise non-uniform stress distribution over the vane 16*a*. As a result thereof, stress peaks may occur which may result in a damage to the vane 16*a*.

In the embodiment of the vane wheel 10*a* according to FIG. 1, the enveloping circle of the bent vanes 14, 16 is illustrated by the circles 34, 36. Here, the outer circle 34 indicates the enveloping circle of the surface of the vane 16*a* that is arranged at the front, as viewed in the direction of rotation P1. Likewise, the circle 36 indicates the enveloping circle of the rear surface of the vane 16*a*.

Figure 2:
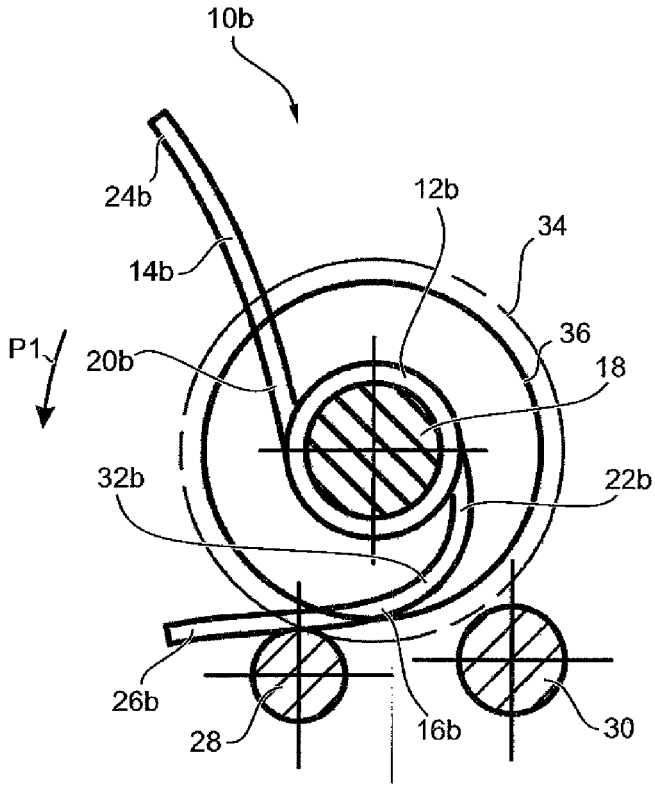
FIG. 2 PRIOR ART
FIG. 2 shows a schematic illustration of a developed embodiment of a vane wheel.

In FIG. 2, a schematic illustration of a developed embodiment of a vane wheel 10*b* is shown. Elements having the same structure or the same function are identified with the same reference signs. The longitudinal axes of the connecting areas 20*a*, 22*b* of the vanes 14*b*, 16*b* are neither orthogonal nor parallel to a tangent to the basic body 12*b* at the respective points of connection where the vanes 14*b*, 16*b* are connected to the basic body 12*b*. The vanes 14*b*, 16*b* are thus neither radially nor tangentially connected to the basic body 12*b*. Further, each vane 14*b*, 16*b* comprises at least one press-on area 24*b*, 26*b*.

As a result of the non-radial connection of the vanes 14*b*, 16*b* to the basic body 12*b* of the vane wheel 10*b*, the vanes 14*b*, 16*b* are bent less strongly by the contact with the adjacent elements 28, 30, as compared to the vanes 14*a*, 16*a* of the vane wheel 10*a* according to FIG. 1. The area of curvature of the vane 16*b* is identified with the reference sign 32*b*. As a result of the lower curvature, i.e. as a result of a curvature having a larger radius of curvature, the stresses occurring in the vanes 14*b*, 16*b* are less than the stresses that occur in the vanes 14*a*, 16*a* having a radial connection. The occurring stresses are however nevertheless relatively high and result in a high decrease in the stiffness of the vanes 14*b*, 16*b* and in a high decrease in their tension. The enveloping circle (not illustrated in FIG. 2) resulting in the case of the connection of the vanes 14*b*, 16*b* shown in FIG. 2 is smaller than the enveloping circle 34, 36 in the case of the radial connection of the vanes 14*a*, 16*a*. For a comparison, the enveloping circles 34, 36 that result in the case of a radial connection of the vanes 14*a*, 16*a* to the basic body 12*a*, are, as in FIG. 1, likewise illustrated in FIG. 2. In particular, the enveloping circle resulting from the connection of the vanes 14*b*, 16*b* as shown in FIG. 2 has a radius which amounts to approximately 90% of the radius of the enveloping circle that results in the case of the radial connection of the vanes 14*a*, 16*a* according to FIG. 1.

Figure 3:
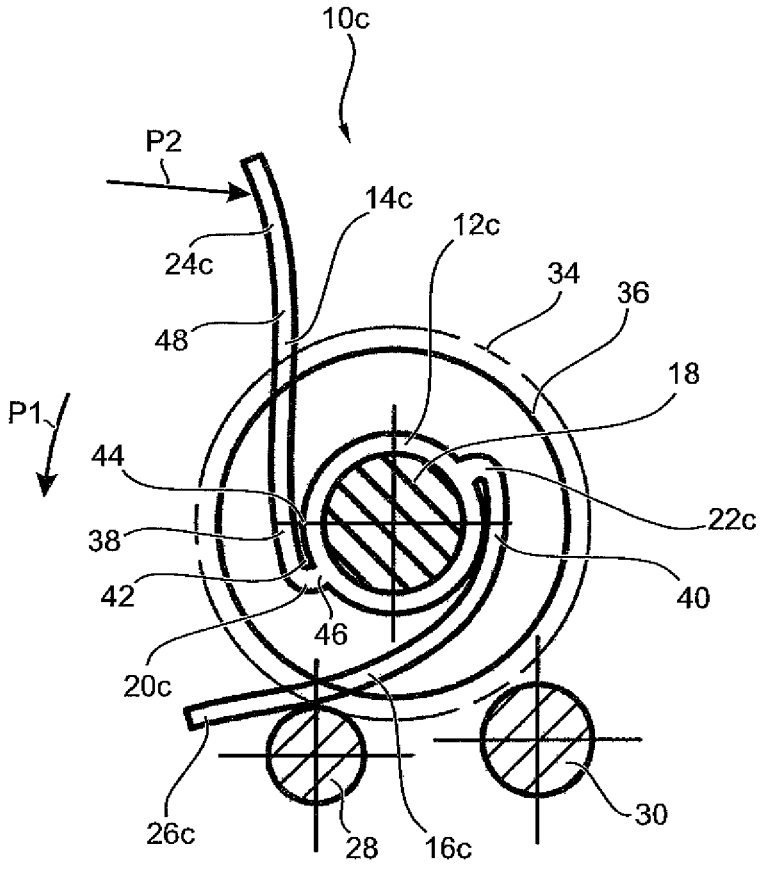
FIG. 3 shows a schematic illustration of an inventive embodiment of a vane wheel.
Figure 4:
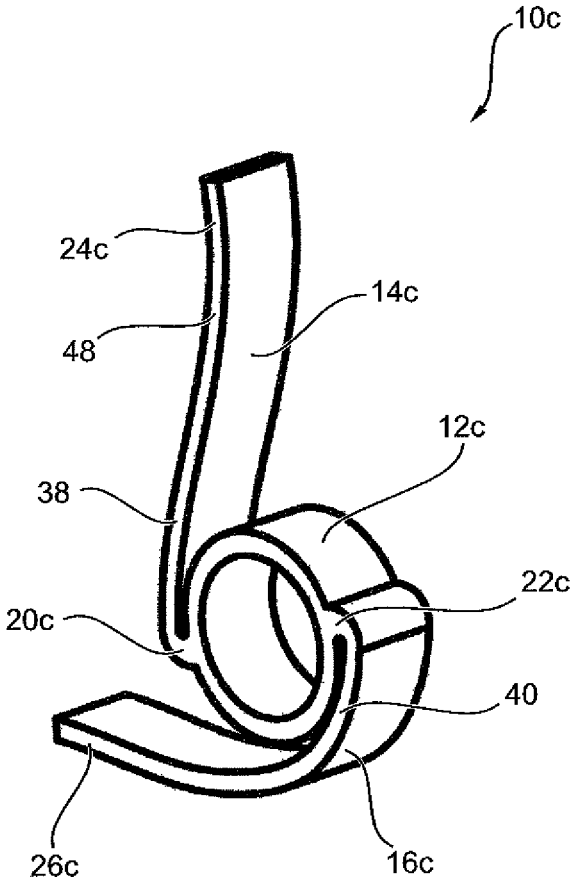
FIG. 4 shows a schematic perspective illustration of the vane wheel according to FIG. 3.

In FIG. 3, a schematic illustration of an inventive embodiment of a vane wheel 10*c* is illustrated. In FIG. 4, a schematic perspective illustration of the vane wheel 10*c* according to FIG. 3 is shown. The vane wheel 10*c* comprises two vanes 14*c*, 16*c*. The force exerted on the vane 14*c* by the last note of value of the value note stack when the note of value is pressed on with the aid of the vane 14*c* is illustrated in FIG. 3 by the arrow P2.

The vanes 14*c*, 16*c* each comprise a support area 38, 40 which contacts the circumferential surface of a basic body 12*c* when the respective vane 14*c*, 16*c* exerts a force on the last note of value of the value note stack via a press-on area 24*c*, 26*c*. The vane 14*c*, 16*c* thus rests against the basic body 12*c* and is supported by the basic body 12*c*. As a result thereof, the force P2 exerted by the note of value on the vane 14*c*, 16*c* is transmitted from the vane 14*c*, 16*c* to the basic body 12*c* via a larger area so that the occurring stresses are lower. The vane 14*c*, 16*c* in particular rests against an area of the basic body 12*c* that is the larger the higher the force P2 exerted on the vane 14*c*, 16*c*. The vane 14*c* is in particular designed such that the vane 14*c* does not contact the basic body 12*c* in at least an area 42 when the vane 14*c* exerts a force on the last note of value of the value note stack. The vane 16*c* is designed analogously to the vane 14*c* so that the explanations described with respect to the vane 14*c* apply accordingly to the vane 16*c* and the explanations described with respect to the vane 16*c* apply accordingly to the vane 14*c*. The gap which exists in the unstressed state between the vane 14*c*, 16*c* and the basic body 12*c* should be as little as possible so that the vane 14*c*, 16*c* quickly rests against the basic body 12*c* upon contact with a note of value. The unstressed state is the state in which the vane 14*c*, 16*c* does not exert any force on a note of value and the vane 14*c*, 16*c* is not bent by adjacent elements 28, 30.

The vane 14*c* is fashioned such that the support area 38 runs parallel to a tangent to the basic body 12*c* at a first point 44. The point of connection 46 between the vane 14*c* and the basic body 12*c* is arranged downstream of the first point 44 by a first angle, as viewed in the direction of rotation P1 of the basic body 12*c*. This angle has in particular a value in the range between 0° and 45°, preferably in the range between 10° and 30°. Thus, it is achieved that the vane 14*c* is longer and thus also softer than a vane that is connected tangentially to the basic body 12*c* at the first point 44. As compared to the shorter, tangentially connected vane, such a soft vane 14*c* is subjected to less mechanical stress when the same force is exerted.

Between the longitudinal axis of a connecting area 20*c* of the vane 14*c* and a tangent to the basic body 12*c* at the point of connection 46, there is an angle in the range between 70° and 110°. In a preferred embodiment of the invention, this angle amounts to about 90° so that the connecting area 20*c* of the vane 14*c* is radially connected to the basic body 12*c*.

Further, the vane 14*c* is fashioned such that in the unstressed state of the vane 14*c*, there is an angle in the range between 70° and 110°, preferably an angle of about 90° between the support area 38 and the connecting area 20*c*. In this way, it is achieved that the connecting area 20*c* of the vane 14*c* projects radially from the basic body 12*c* and the support area 38 of the vane 14*c* nevertheless runs parallel to a tangent to the basic body 12*c* at the first point 44. A transition area between the support area 38 and the connecting area 20*c* is preferably curved opposite to the direction of rotation P1, in particular fashioned in the form of a radius.

The form and connection of the vanes 14*c*, 16*c* previously described and shown in FIGS. 3 and 4 is also referred to as a downstream connection of the vanes 14*c*, 16*c*. By way of this downstream connection of the vanes 14*c*, 16*c* it is achieved that the enveloping circle resulting by the contact with the adjacent elements 28, 30 is substantially smaller than the enveloping circle 34, 36 in the case of a radial connection of the vanes 14*a*, 16*a*. The resulting enveloping circle is not illustrated in FIG. 3 and in particular has a radius which only amounts to about 70% of the radius that results in the case of a radial connection of the vanes 14*a*, 16*a*. For comparison, the enveloping circles 34, 36 which result in the case of a radial connection of the vanes 14*a*, 16*a* are illustrated in FIG. 3. As a result of the substantially smaller enveloping circle, with the stress on the vane wheel being the same, a more compact design of the device in which the vane wheel 10*c* is inserted is possible.

Further, as a result of this downstream connection of the vanes 14*c*, 16*c* it is achieved that the vane 16*c* is less strongly bent by the contact with the adjacent element 28 so that the radius of curvature is larger compared to the radii of curvature in the embodiments of the vane wheels 10*a*, 10*b* according to FIGS. 1 and 2. The center of the radius of curvature is arranged near the longitudinal axis of the basic body 12*c*. Advantageously, the center of curvature lies on the longitudinal axis of the basic body 12*c*. In this way, it is in turn achieved that the stresses to which the vanes 14*c*, 16*c* are subjected are lower and thus that material fatigue, in particular the decrease in the stiffness of the vanes 14*c*, 16*c*, is reduced. Likewise, by the uniform curvature a uniform stress curve across the vane 14*c*, 16*c* is achieved and the occurrence of local stress peaks and a possible damage to the vane wheel 10*c* are prevented or reduced. In particular, a connecting area 20*c*, 22*c* of the vane 14*c*, 16*c*, at the end of which the vane 14*c*, 16*c* is connected to the basic body 12*c*, is eased from stress by supporting the vane 14*c*, 16*c* with the support area 38, 40 against the basic body 12*c*. The vanes 14*c*, 16*c* are in particular fashioned such that the vane 14*c*, 16*c* only exerts a force on a note of value when the support area 38, 40 rests at least in part against the basic body 12*c*.

Further, the vane 14*c* comprises a counter area of curvature 48 that is curved such that the end of the vane 14*c* that is not connected to the basic body 12*c* points in the direction of rotation P1. By this counter curvature of the vane 14*c*, it is achieved that the bending of the vane 14*c* backward opposite to the direction of rotation P1 is at least in part compensated for by the bearing of the vane 14*c* against the basic body 12*c*. In this way, it is guaranteed that the force required for retaining the last note of value of the value note stack is provided by the press-on area 24*c*, in particular by the end of the vane 14*c* opposite to the basic body 12*c*. Altogether, the vane 14*c* is thus S-shaped.

The vanes 14*c*, 16*c* and the basic body 12*c* are in particular formed as one piece. The vane wheel 10*c* is advantageously made of an uncured elastomer, in particular of polyurethane (PU), of a thermoplastic elastomer (TPE) or of polyester urethane rubber (Vulkollan) and is, for example, made by injection molding. Alternatively, the vane wheel 10*c* may also be made of cross-linked elastomers.

The vanes 14*c*, 16*c* of the vane wheel 10*c* are offset by 180°. In an alternative embodiment of the invention the vanes 14*c*, 16*c* may also be offset by an angle other than 180°. Further, also more or less than two vanes 14*c*, 16*c* may be provided. In other embodiments, the vane wheel 10*c* may in particular only have one vane 14*c*, 16*c* or four vanes 14*c*, 16*c*, offset by 90°.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for the input of notes of value into a container, comprising:

at least one vane wheel for handling the notes of value, comprising a rotatably mounted basic body and at least one vane firmly connected to the basic body at a first end of a connecting area;

wherein the vane comprises a press-on area for exerting a force on at least one note of value and a support area;

wherein the support area contacts the circumferential surface of the basic body when the vane exerts a force on a note of value; and wherein the vane does not contact the basic body at least in an area between the connecting area and the support area when the vane exerts a force on a note of value and the support area contacts the circumferential surface of the basic body.

2. The vane wheel according to claim 1, wherein between a longitudinal axis of the connecting area of the vane and a tangent to the basic body at the point of connection where the vane is connected to the basic body there is an angle in the range between 70° and 110°.

3. The vane wheel according to claim 1, wherein the connecting area of the vane is radially attached to the circumferential surface of the basic body.

4. The vane wheel according to claim 1, wherein in an unstressed state of the vane there is an angle in the range between 70° and 110°, in particular an angle of about 90° between the connecting area and the support area.

5. The vane wheel according to claim 1, wherein the basic body and the vane are formed as one piece.

6. The vane wheel according to claim 1, wherein the basic body is a hub rotatably mounted about its longitudinal axis.

7. The vane wheel according to claim 1, wherein two vanes, in particular two vanes offset by 180° are provided.

8. The vane wheel according to claim 1, wherein at least a part of the vane has a curvature opposite to the direction of rotation of the vane wheel when a force is exerted on a note of value.

9. The vane wheel according to claim 7, wherein the center of curvature of the curvature of the vane lies within a space delimited by the circumferential surface of the basic body, preferably on the axis of rotation of the basic body.

10. The vane wheel according to claim 1, wherein the vane has an S-shaped area.

11. The vane wheel according to claim 1, wherein the vane wheel is made of an uncured elastomer.

12. A device for the input of notes of value into a container comprising at least one vane wheel for handling the notes of value, comprising a rotatably mounted basic body and at least one vane firmly connected to the basic body at a first end of a connecting area;

wherein the vane comprises a press-on area for exerting a force on at least one note of value and a support area;

wherein the support area contacts the circumferential surface of the basic body when the vane exerts a force on a note of value; and wherein the connecting area of the vane is radially attached to the circumferential surface of the basic body.

13. The device of claim 12, wherein the basic body and the vane are formed as one piece.

14. The device of claim 12, wherein between a longitudinal axis of the connecting area of the vane and a tangent to the basic body at the point of connection where the vane is connected to the basic body there is an angle in the range between 70° and 110°.

15. The device of claim 12, wherein the vane has an S-shaped area.

16. The device of claim 12, wherein the vane wheel includes an uncured elastomer.

17. The device of claim 12, wherein at least a part of the vane has a curvature opposite to the direction of rotation of the vane wheel when a force is exerted on a note of value.

18. A vane wheel for handling notes of value, comprising a rotatably mounted basic body and at least one vane firmly connected to the basic body at a first end of a connecting area, wherein the vane comprises a press-on area for exerting a force on at least one note of value and a support area, wherein the support area contacts the circumferential surface of the basic body when the vane exerts a force on a note of value, and wherein the support area does not contact the circumferential surface of the basic body when the vane does not exert a force on the note of value.

* * * * *